US006070031A

United States Patent [19]

Haneda et al.

[11] Patent Number: 6,070,031

[45] Date of Patent: May 30, 2000

[54] COLOR IMAGE FORMING APPARATUS HAVING DEVELOPING DEVICES ARRANGED AROUND AN IMAGE FORMING BODY SUCH THAT THE IMAGE FORMING BODY IS NEITHER DEFORMED NOR DAMAGED BY THE DEVELOPING DEVICES AND SUCH THAT A PRECISE GAP IS SET THEREBETWEEN

[75] Inventors: Satoshi Haneda, Hachioji; Toshihide Miura, Koganei, both of Japan

[73] Assignee: Konica Corporation, Tokyo, Japan

[21] Appl. No.: 08/969,170

[22] Filed: Nov. 12, 1997

[30] Foreign Application Priority Data

Nov. 18, 1996 [JP] Japan ..... 8-306397
Nov. 21, 1996 [JP] Japan ..... 8-310630

[51] Int. Cl.[7] ..... G03G 15/00; G03G 21/18

[52] U.S. Cl. ..... 399/112; 399/113; 347/118; 347/152

[58] Field of Search ..... 347/115, 138, 347/152, 118; 399/112, 113, 116, 117, 119, 167

[56] References Cited

U.S. PATENT DOCUMENTS

| | | | |
|---|---|---|---|
| 4,203,386 | 5/1980 | Blochl et al. | 399/119 |
| 4,583,832 | 4/1986 | Kasamura et al. | 399/119 |
| 5,541,722 | 7/1996 | Ikeda et al. | 399/178 |
| 5,608,498 | 3/1997 | Nagase et al. | 399/130 |
| 5,615,002 | 3/1997 | Haneda et al. | 399/227 |

FOREIGN PATENT DOCUMENTS 5-307307 11/1993 Japan .

*Primary Examiner*—Joan Pendegrass
*Attorney, Agent, or Firm*—Frishauf, Holtz, Goodman, Langer & Chick, P.C.

[57] ABSTRACT

A color image forming apparatus includes: a rotary image forming body; a plurality of charging units provided along the image forming body for charging the image forming body; a plurality of exposure units each provided inside the image forming body for imagewise exposing the image forming body to form a latent image; a plurality of developing units each storing therein colored developer different from each other, provided along the image forming body, for developing the latent image formed on the image forming body to form a colored toner image different from each other. After a plurality of different colored toner images are superimposed on the image forming body through successively repeating of charging by the charging unit, imagewise exposing by the exposure unit and developing by the developing unit to form a colored toner image during one rotation of the image forming body, the superimposed toner images are collectively transferred onto a transfer member. The apparatus further includes a process cartridge integrally having the plurality of charging units, the image forming body having therein the plurality of exposure units and the plurality of developing units, wherein the plurality of developing units are detachably attachable to the process cartridge.

15 Claims, 10 Drawing Sheets

COLOR IMAGE FORMING APPARATUS HAVING DEVELOPING DEVICES ARRANGED AROUND AN IMAGE FORMING BODY SUCH THAT THE IMAGE FORMING BODY IS NEITHER DEFORMED NOR DAMAGED BY THE DEVELOPING DEVICES AND SUCH THAT A PRECISE GAP IS SET THEREBETWEEN

BACKGROUND OF INVENTION

The present invention relates to a color image forming apparatus utilizing an electrophotgraphic method in which in image forming apparatuses such as copiers, printers, facsimile machines and the like, around an image forming body are arranged a plurality of sets of a charging means, an image exposure means and a developing means and during one rotation of the image forming body, toner images are superimposed to form a color image.

Heretofore, multicolor image forming apparatuses have been known in which the same number of image forming bodies, charging means, developing means, etc. as the number of colors necessary to form an image are provided and a single colored toner image formed on each of the image forming bodies is superimposed on an image receiving material to form a color image; an image forming body is rotated a plurality of times and charging, image exposure and development for each color are repeated to form a color image, and during one rotation of an image forming body, charging, image exposure and development for each color are successively performed to form a color image.

However, it has been found that each of the above-mentioned apparatuses has the following problems. The color image forming apparatus in which the same number of the image forming bodies, charging means, developing means and the like as the number of colors necessary to form an image are provided and one-colored toner images are superimposed on a image receiving material to form a color image results in disadvantages such as the increase in volume of the apparatus due to the requirement of a plurality of image forming bodies and transporting members for image receiving materials. On the other hand, the apparatus in which the image forming body is rotated a plurality of times and charging, image exposure and development are repeated for each color to form a color image enables the volume of the apparatus to be small. However, there is limitation such that the size of a formed image should be less than the surface area of the image forming body.

The apparatus in which during one rotation of the image forming body, charging, image exposure and development for each color is successively performed to form a color image exhibits advantages such that there is no limitation on the image size and further, a high speed image formation is possible. Furthermore, for example, Japanese Patent Publication Open to Public Inspection No. 5-307307 proposes that a transparent substrate is employed as a substrate of the image forming body and the decrease in size of an apparatus is accomplished by arranging an image exposure means in the interior of the image forming body.

However, in the developing means utilizing a single component developer, it is necessary to exchange, at different occasions, the developing means for each color when the developer is used up. Accordingly, it is required that each developing means is readily exchanged and the gap between the image forming body and the developing sleeve of the developing means is accurately set to a predetermined value. Furthermore, a method has been employed in which a gap-holding means is allowed to come into contact with the image forming means and the gap between the image forming means and the developing sleeve provided with the developing means is set. However, problems have been caused in that the image forming means is deformed or damaged by the gap-holding means.

Conventionally, portions for holding the image forming means have been structured by forcibly inserting flange materials into both ends of the image forming means. However, when the flange material is forcibly inserted, the portion subjected to forcible insertion is deformed. Thus, it is hard to hold accurate development gaps of a plurality of developing devices which are disposed so as to have predetermined gaps by the gap-holding means brought into contact with the end of the image forming body. A problem is then caused in which no preferable images are obtained. Particularly, when a resin body is employed as that of the image forming body, the deformation is remarkably caused by the forcible insertion of the flange material and the predetermined gap is not held which is disposed by the gap-holding means brought into contact with the end of the image forming body. Furthermore, a problem is caused in which the gap-holding means is vibrated by the vibration of a bearing as a bearing member and an image forming body driving gear.

Furthermore, the inventors of the present invention have investigated a small-sized process cartridge to which a plurality of the developing means are removably attached. However, when attempting to decrease the size of the process cartridge of which enclosure is liable to become a weak structure on account of the above-mentioned developing means removably attached, a large space is required for detaching the developing means. Thus, a problem has been caused in that a reinforcing member such as a stay, etc. which has been employed to reinforce the enclosure of a conventional process cartridge is not provided.

Furthermore, when the reinforcing member is not provided to the enclosure of the above-mentioned small-sized cartridge, the removably attached developing means occupies a large space and the enclosure of the process cartridge becomes weak and is deformed. As a result, it is difficult to hold, at a position having high precision, both of the developing means and the image forming member with which the gap-holding means is brought into contact. Furthermore, when the enclosure of the process cartridge becomes weak to result in deformation, the image forming body is not securely held by both side plates of the process cartridge. As a result, it becomes difficult to position highly accurately and hold both the image forming body and image exposure means which contains the image forming body.

SUMMARY OF THE INVENTION

A first object of the present invention is to provide a color image forming apparatus in which no image forming body is deformed or damaged by a plurality of developing means arranged around the image forming body, and when exchanging the developing means, a predetermined gap between the image forming body and the developing means is set with high precision.

A second object of the present invention is to provide a color image forming apparatus in which the reinforcement of an enclosure of a process cartridge having a plurality of removably attached developing means without employing a reinforcing member is carried out.

In a color image forming apparatus in which along a rotating image forming body, there are arranged a plurality of sets of a charging means which charges the above-mentioned image forming body, an image exposure means which imagewise exposes onto the charged image forming body to form a latent image and a developing means which develops the latent image formed on the image forming body to form a toner image, and during one rotation of the above-mentioned image forming body, charging by the above-mentioned charging means, image exposure by the above-mentioned image exposure means, and development and formation of a toner image by the above-mentioned developing means are repeated successively, and a plurality of toner images are superimposed on the above-mentioned image forming body, and the superimposed toner images are then simultaneously transferred to an image receiving material, the above-mentioned objects have been accomplished by the image forming apparatus characterized in that a plurality of the above-mentioned charging means and the above-mentioned image forming body containing a plurality of the above-mentioned image exposure means and a plurality of the above-mentioned developing means arranged along the above-mentioned image forming body are integrally employed as a process cartridge and a plurality of the above-mentioned developing means are attached removably to the above-mentioned process cartridge.

DETAILED DESCRIPTION OF THE PREFERRED EMBODIMENT

Embodiments of the present invention are explained hereinafter. Furthermore, in the explanation of the embodiments hereinafter, when a colored toner image is transferred to an image receiving material, the image transferred to the surface (referred to as the obverse side surface or upper surface) of the image receiving material facing against the image forming body in a transfer zone is termed an obverse image and the image transferred to the surface (referred to as the reverse side surface or lower surface) of the other side of the image receiving material is termed a reverse image.

Figure 1:
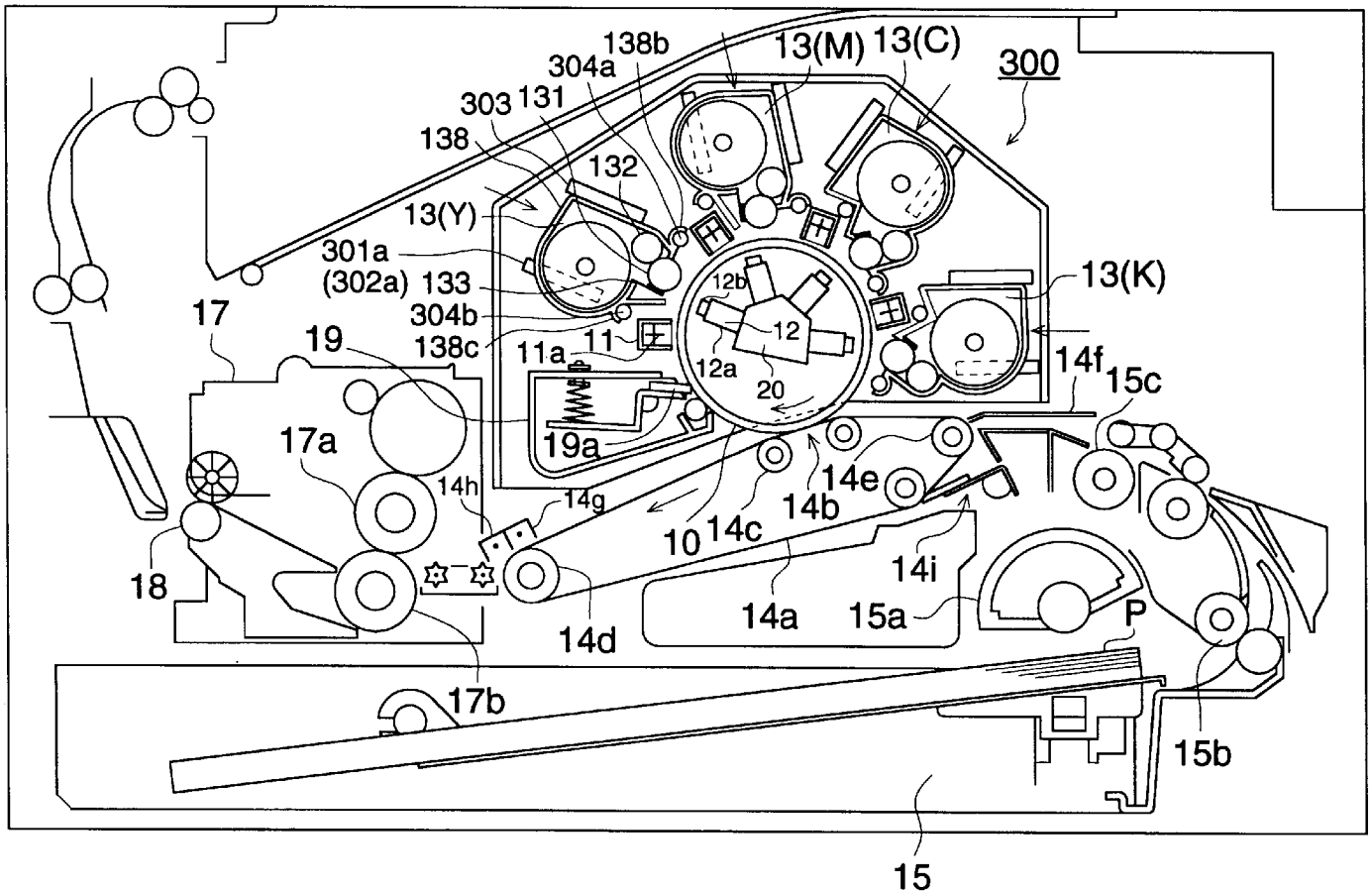
FIG. 1 is a sectional view of a structure of a color image forming apparatus showing the one embodiment of the present invention.
Figure 2:
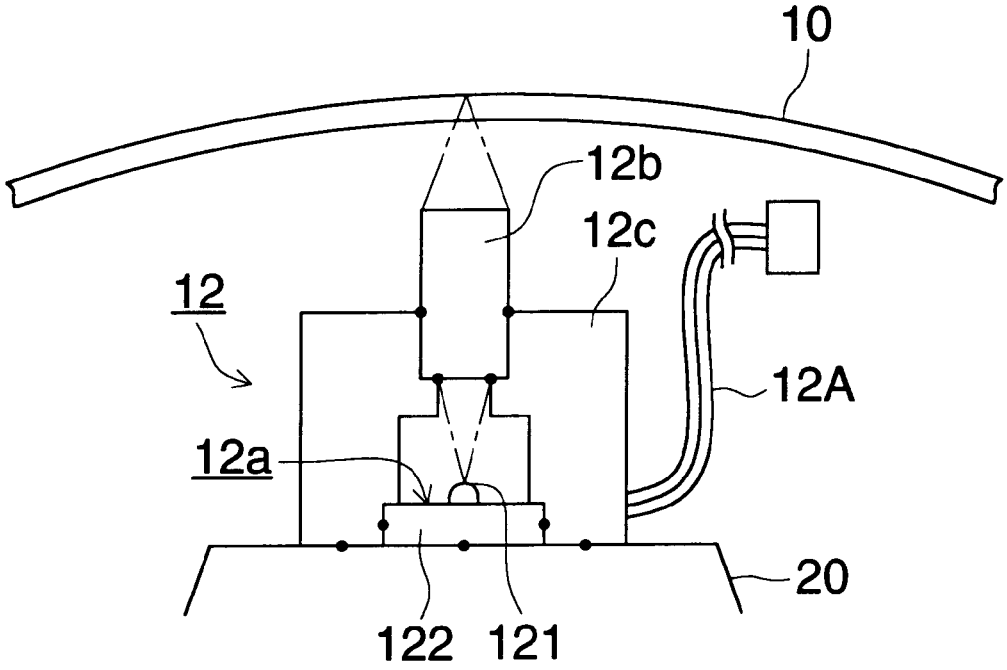
FIG. 2 is an enlarged sectional view of the main part of the image exposure means in FIG. 1.
Figure 3:
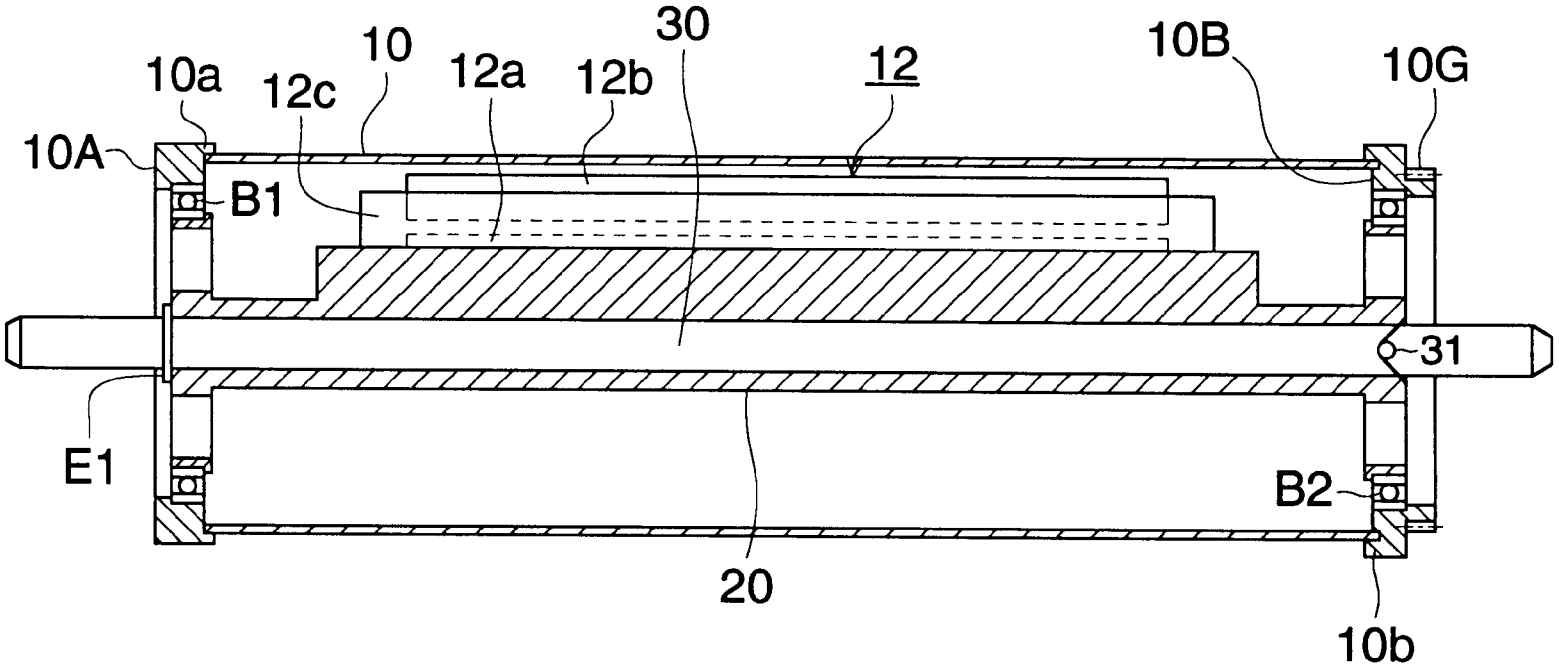
FIG. 3 is a side sectional view of the image forming body in FIG. 1.
Figure 4:
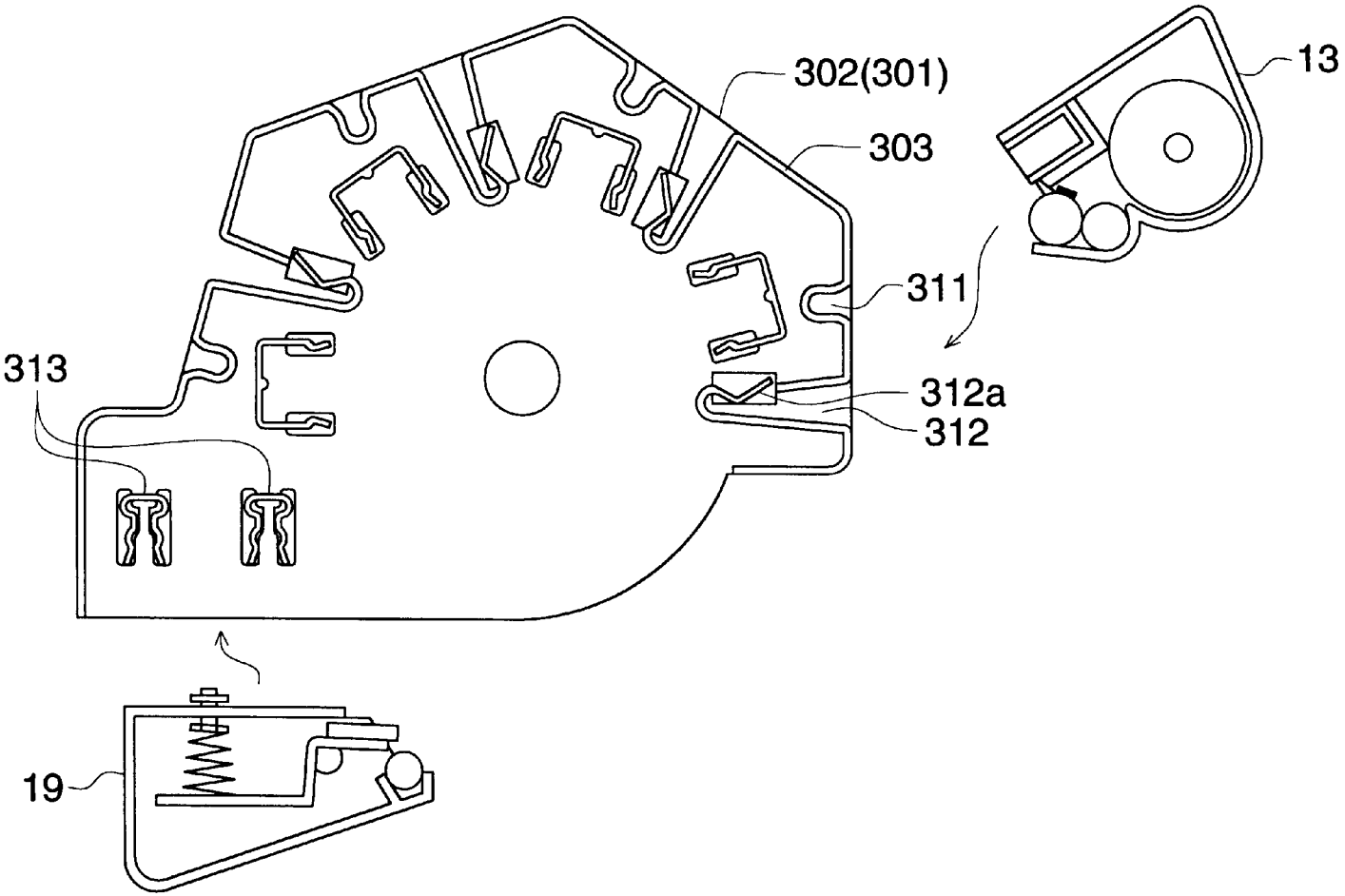
FIG. 4 is a diagram showing a guide means for inserting a developing means provided in a side panel of a process cartridge.
Figure 5:
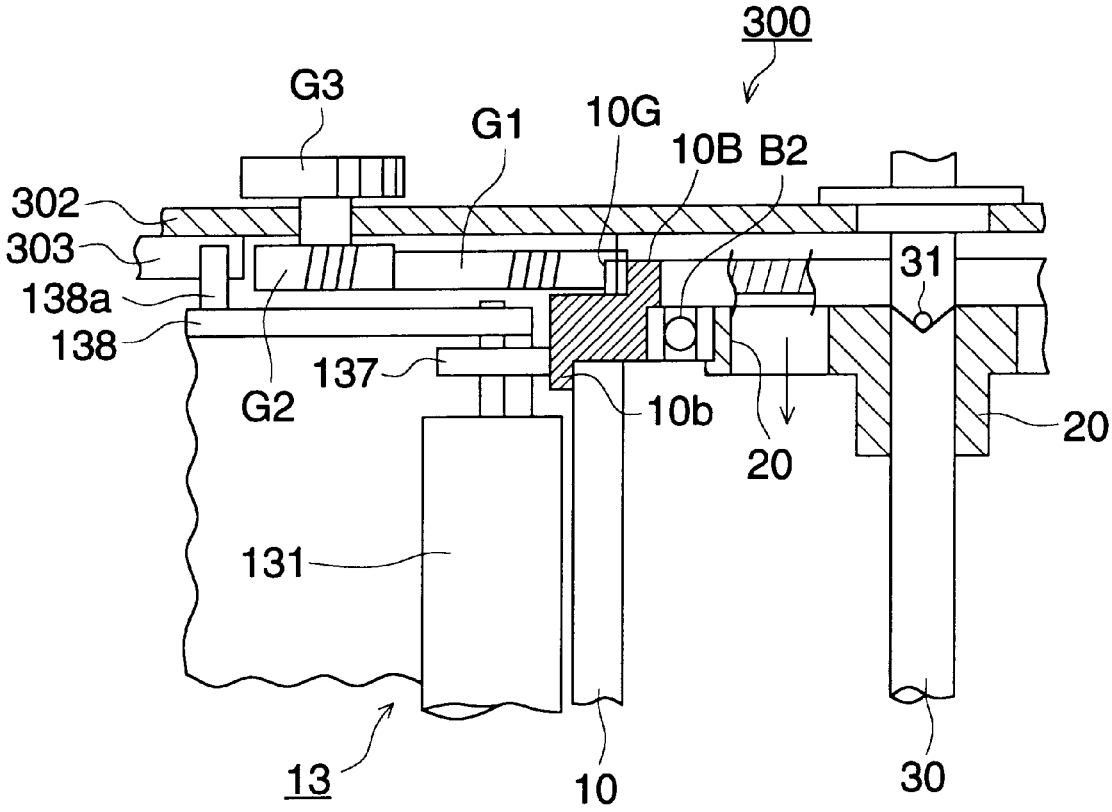
FIG. 5 is a diagram showing the first example of a contact method of a gap-holding means.

An image forming process in one embodiment of the color image forming apparatus and each mechanism for accomplishing the first object of the present invention are explained with reference to FIGS. 1 to 7. FIG. 1 is a sectional view showing a structure of one embodiment of the color image forming apparatus of the present invention; FIG. 2 is an enlarged diagram showing the main part of the image forming means in FIG. 1; FIG. 3 is a side sectional view of the image forming body in FIG. 1; FIG. 4 is a diagram showing a guide means for inserting a developing means provided in a side panel of a process cartridge and FIG. 5 is a diagram showing the first example of an contact method of a gap-holding means. The color image forming apparatus shown in FIG. 1 has a belt-like transfer means; furthermore, on both surfaces of an image receiving material, toner images are formed using a belt-like member and the resulting images are simultaneously fixed. However, the present invention is not limited to the image formation on both surfaces.

As is seen in FIG. 1, a photoreceptor drum 10, which is an image forming body, is constructed in such a way that, for example, a cylindrical substrate formed by a transparent material composed of a transparent acrylic resin is interiorly provided, and a transparent electrically conductive layer and a photosensitive layer composed of an organic photosensitive compound (OPC) are exteriorly formed on the above-mentioned substrate, and is grounded and rotated clockwise shown as arrow in FIG. 1.

In the embodiment, it is allowed that the photoelectrically conductive layer in the photoreceptor drum has exposure sensitivity so that an appropriate contrast is obtained for an image exposure to the drum. Accordingly, it is not necessary that light transmittance of the substrate composed of a light-transmitting resin in the photoreceptor drum is 100% and during the transmission of an exposure beam, properties such that the beam is partly lost by absorption is allowed. As materials for the transparent substrate, acrylic resins, especially, a polymer obtained by the polymerization of a methylacrylate ester monomer are excellent in transparency, strength, accuracy, surface properties, etc. and are preferably employed. In addition to these, can be employed various kinds of light-transmitting resins such as fluorine resins, polyester, polycarbonates, polyethylene terephthalate, etc. which are employed as general optical parts and materials. Furthermore, the light-transmitting substrate may be colored unless an exposure light is absorbed. The refractive index of these resins is approximately 1.5.

As a manufacturing method of the substrate composed of a light-transmitting resin, a centrifugal polymerization method can be employed for manufacturing a raw cylinder with high precision. In the manufacturing method, a monomer employed for a resin material is synthesized; a polymerization catalyst is added; the resulting mixture is then pored to a cylindrical mold and tightly sealed and fixed by side panels, and the resulting is rotated upon heating at a suitable temperature to enhance homogeneous polymerization. After completing the polymerization, the resulting light-transmitting resin is cooled and then taken out from the mold and cut. Thereafter, if desired, the resin is processed through a finishing process and a substrate for the photoreceptor drum is manufactured (centrifugal polymerization method).

As a raw material for the light-transmitting resinous substrate molded by the centrifugal polymerization, the polymer prepared by the polymerization of the methyl methacrylate ester monomer, as mentioned above, is excellent in transparency, strength, precision, surface properties, etc. However, in addition to the above, polyethyl methacrylate, polybutyl methacrylate, polyethyl acrylate, polybutyl acrylate, polystyrene, polyimide, polyester, polyvinyl chloride, etc. or copolymers thereof, etc. can be employed. In the centrifugal polymerization method, a degree of roundness depends on a mold employed for molding and thus, a substrate with high precision can be obtained. Particularly, the substrate with excellent precision in the outer diameter can be obtained. Furthermore, uneven wall thickness in the mold varies according to uneven rotation at polymerization, viscosity, heating conditions at polymerization.

By employing the resinous cylindrical light-transmitting substrate, there is provided a photoreceptor drum which is uniform in wall thickness and excellent in a degree of shape as a cylinder and roundness, and is easier in manufacturing and lower in cost than glass materials conventionally employed as light-transmitting base bodies.

Subsequently, film manufacturing methods of an electrically conductive light-transmitting layer include a vacuum evaporation method, an active reaction evaporation method, various kinds of sputtering methods and various kinds of CVD methods. Thin layers maintaining definite light transmittance are employed which are prepared by any of these methods and composed of indium, tin, oxide (ITO), alumina, tin oxide, lead oxide, indium oxide, copper iodide, Au, Ag, Ni, Al, etc. Furthermore, electrically conductive resin layer and the like composed of fine particles of the above-mentioned transparent and electrically conductive material (for example, ITO) are preferably employed which are prepared using an immersion coating method and a spray coating method. In this case, in order to increase the light transmittance, the size of particles composing the layer is preferably controlled to about 500 Angstroms or less in the region of Rayleigh scattering (scattering caused by a fine particle having a size of 1/10 of exposure wavelength or less). Particularly, as the main composition materials, electrically conductive fine particles having a primary particle diameter of 400 Angstroms or less and the particles having particle radius distribution controlled to ±100 Angstroms or less can be preferably employed.

The organic photosensitive layer consists of two layers, that is, a charge generating layer (CGL) having a charge generating material (CGM) as a main component and a charge transport layer (CTL) having a charge transport material (CTM) as a main component which are functionally separated. The organic photosensitive layer consisting of two layers has high transmittance for an image exposure light due to the thin CGL and is suitable for the present invention. Further, the organic photosensitive layer may be fabricated to be a single layer in which the charge generating material (CGM) and the charge transport material (CTM) are comprised in one layer. The photosensitive layer composed of the single layer and the above-mentioned two layers incorporates generally a binder resin.

A scorotron charging device 11 as a charging means is employed for an image forming process for each color of yellow (Y), magenta (M), cyan (C) and black (K) and is attached perpendicularly to the moving direction of the photoreceptor drum 10 as the image forming body while facing the photoreceptor drum 10, and has a control grid held at a predetermined electric potential against the above-mentioned organic photosensitive layer of the photoreceptor drum and a discharge electrode 11*a* composed of, for example, a saw-toothed electrode, and conducts a charging function (in the present embodiment, negative polarity) by corona discharging having the same polarity as that of a toner to charge uniformly the photoreceptor drum. As the discharge electrode 11*a*, a wire electrode can be employed in addition to the above.

An exposure optical system 12 as the exposure means for each color is arranged so that an exposure onto the photoreceptor drum 10 is positioned between the discharge electrode 11*a* of the scorotron charging device and the development position of a developing device 13.

The exposure optical system 12 as an exposure means for each color of Y, M, C and K is constructed as follows. As an exposure system, for example, a line exposure element 12*a* in which a plurality of LEDs (light emitting diode) as a light emitting element are arranged in an array which are arranged on the rectangular base plate composed of ceramic in the main scanning direction in parallel to the axis of the photoreceptor drum 10 is attached to a lens holder 12*c* as an image formation element holding member holding a light-converging light transmission body (trade name is SELFOC lens.) 12*b* as an image formation element, and is constructed as a unit. For example, the exposure element 12*a* and the SELFOC lens 12*b* are fixed to the lens holder 12*c* using a bonding agent shown as black dots in FIG. 2. Furthermore, for example, with the use of the bonding agent shown as black dots in FIG. 2, the exposure optical system 12 for each color is attached to a holding member 20 as the common holding member holding each exposure optical system and is placed in the interior of the photoreceptor drum 10.

The exposure optical system 12 for each color is provisionally attached directly onto a holding member without employing a wedge-shaped pasting member and is adjusted in advance using tooling etc. so as to enable positioning the main scanning direction of the photoreceptor drum 10 and the sub-scanning direction or the rotational direction of the photoreceptor drum 10 and is fixed by a bonding agent to the holding member at positions as shown by black dots in FIG. 2, which is the common holding member of the exposure optical system 12 for each color. Thus, the decrease in size of the holding member 20 to which the exposure optical system 20 is provided is accomplished. Namely, the decrease in size of the image exposure means is accomplished.

Furthermore, a lead wire 12A is pull out from a terminal of a base board 122 of LED 121 and is pull out from the exposure optical system 12 along the side wall of the lens holder 12*c*. Because the lead wire 12A is pull out along the side wall of the lens holder 12*c* from the terminal of the base board 122, the exposure optical system 12 can be attached in a narrow space and furthermore, the decrease in size of the image exposure means is accomplished.

Image data of each color are read by an image scanner as another body or are input as external signals, etc. The image data stored in a storage section, not shown, for example, in RAM are successively read out from the storage section through the control section of the apparatus itself and are input to the exposure optical system as electric signals of each color and the LED provided in the exposure element 12*a* of each color lights using, for example, a pulse width modulation method (PWM method). The wavelength of the light-emitting element employed in this embodiment is in the region of 600 to 900 nm.

As the above-mentioned exposure element, in addition to the above, are employed array-like arrangement consisting of a plurality of light emitting element such as FL (fluorescent luminescence), EL (electroluminescence), PL (plasma discharge), etc. The wavelength of light emitted by a light-emitting element employed in the embodiment, when the exposure is carried out from the outside, is usually in the range of 780 to 900 nm in which M and C toners have high transmittance. However, according to the present invention, an image exposure is carried out from the outside. Accordingly, the wavelength of 400 to 780 nm is allowed which is shorter than the above where no sufficient transmittance exhibited for the colored toner.

Developing devices 13 are provided according to the order of color in the formation of an image around the photoreceptor drum 10 which is rotated. In the present embodiment, a Y and an M developing devices 13 are arranged in the left side of the photoreceptor drum 10 as shown in FIG. 1; a C and a K developing devices 13 are arranged in the right side of the photoreceptor drum 10; the scorotron charging device 11 is arranged under a development casing 138 of the Y and M developing devices 13 and the scorotron charging device 11 is arranged above the development casing 138 of the C and K developing device 13.

The developing devices 13 as the developing means for each color are loaded with a single component developer of yellow (Y), magenta (M), cyan (C) and black (K) and are provided with a developing sleeve 131 made from cylindrical non-magnetic stainless steel or aluminum material having a thickness of, for example, 0.3 to 0.5 mm and an outer diameter of 10 to 20 mm, which rotates in the same direction as of the photoreceptor drum 10 at the development position, while holding the predetermined gap against the surface of the photoreceptor drum 10.

The developing sleeve 131 is composed of non-magnetic materials such as, for example, aluminum, stainless steel, etc. and the surface undergoes sand blast treatment to form rough surface of 0.5 to 5 $\mu$m in terms of JIS representation of 10 point average roughness (JIS-B0610) and is a developer transport member which is held so as to enable rotation. The developing sleeve 131 rotates in the same rotational direction as of the photoreceptor drum 10 while keeping a predetermined gap against the surface of the photoreceptor drum 10.

The reference numeral 132 as a developer (toner) supply member which supplies toner to the developing sleeve 131 is of a roller composed of a foam material such as sponge or urethane rubber and is provided at the supply zone in parallel with the developing sleeve 131 and is a supply roller which rotates in the same direction as of the developing sleeve 131. Numeral 133 is a regulating member which is provided to regulate the height and amount of a developer layer (toner layer). For example, it is composed of a belt-like elastic plate composed of a plate-like stainless steel or rubber material at the top of which is attached to the contact portion of the developing sleeve 131 and a belt-like elastic member composed a foam material such as, for example, sponge and urethane rubber. The top of the regulating member 133 is arranged so as to direct to the upper flow of the rotational direction of the developing sleeve 131.

The developing devices 13 in which each of striking portions 138*b* and 138*c* of the development casing 138*c* is brought into contact with rod-shaped positioning rods 304*a* and 304*b* as a positioning member for the developing means are held leaving a predetermined gap of 100 to 500 $\mu$m from the photoreceptor drum 10 without being brought into contact with it. At the development performed by the developing device 13 for each color, direct current voltage or alternative current voltage adding development bias is applied to the developing sleeve 131 and jumping development is carried out by a single component developer loaded in the developing device; the direct current bias having the same polarity as that of a toner (in the present embodiment, negative polarity) is applied to the negatively charged photoreceptor drum and non-contact reversal development is carried out in which the toner is adhered to the exposed part. At the time, in order to prevent the formation of uneven image, it is necessary to hold the accuracy of the development gap at about 20 to 50 $\mu$m or less.

An electrostatic latent image on the photoreceptor drum 10 formed by charging by the scorotron charging device 11 and an image exposure by the exposure optical system 12 is reverse developed by the above-mentioned developing device 13 of each color using the charging electrode and a toner having the same polarity (in the present embodiment, the photoreceptor drum is negatively charged and the toner has a negative polarity.) under no contact state by a non-contact development method in which a development bias is applied.

As the one component developer (toner) employed in the above-mentioned developing device, can be used spherical or non-spherical non-magnetic toners which can be obtained using the same method as applied to the conventional toners. Preferred toners are composed of particles having a average particle diameter of 20 $\mu$m or less, preferably 10 $\mu$m or less and more preferably from 1 to 7 $\mu$m which are prepared using the same method as that used to prepare conventional known toners prepared by adding colored components such as color pigments, etc. and charge control agents, etc., if desired, to resins such as stylene series resins, vinyl series resins, ethylene series resins, rosin modified resins, acryl series resins, polyamide resins, epoxy resins, polyester resins, etc. or resins of aliphatic acid waxes such as palmitic acid, stearic acid, etc. Furthermore, if desired, are added fluidizing agents to improve the fluidizing slipping of particles and cleaning agents useful to clean the surface of the image forming body. As the lubricating agents, can be employed colloidal silica, silicone varnish, metal soap or non-ionic surface active agents, etc., and as the cleaning agents, can be employed aliphatic metal salts, silicone substituted with an organic group or fluorinated surface active agents, etc.

The single component developer (toner) is tightly sealed in the developing device 13 and when used up, the developing device itself is exchanged. The toner is triboelectrically charged between the developing sleeve 131, the regulating member 133 and the supply roller 132.

As mentioned above, with the use of the developing means employing the single component developer, the size of the developing devices 13 are reduced and furthermore, the reduction in size of devices around the image forming body is accomplished by utilizing efficiently the room around the image forming body in such a way that each member in the interior of the above-mentioned developing device is arranged radiately around the photoreceptor drum 10 which is positioned in the center.

An image which has been read as an original document by an imaging sensor of an image reading apparatus separated from the present apparatus or has been edited using a computer is once stored as the image data for each color of T, M, C and K.

Upon initiating image copying, the photoreceptor drum 10 is rotated clockwise in the direction shown by arrow in FIG. 1 by starting a photoreceptor member driving motor, not shown, and at the same time, charging the photoreceptor drum 10 is initiated by charging action of the scorotron charging device 11 for yellow (Y) positioned in the left side of the photoreceptor drum 10 and under the development casing 138 of the developing device 13 for Y.

After the photoreceptor drum 10 is charged, in the Y exposure optical system, an exposure is initiated by first color signals, that is, electric signals corresponding to the image data of Y, and an electrostatic latent image corresponding to the Y image of the original is formed on the surface of the photosensitive layer by rotation scanning of the photoreceptor drum 10.

The above-mentioned latent image undergoes reversal development by the Y developing device 13 without contact with the developer, and as the photoreceptor drum 10 is rotated, an yellow (Y) toner image is formed.

Subsequently, on the above-mentioned yellow (Y) toner image, further, charging the photoreceptor drum 10 is performed by charging action of the scorotron charging device 11 for magenta (M) positioned in the left side of the photoreceptor drum 10, above the yellow (Y) and under the development casing 138 of the developing device 13 for M; in the M exposure optical system, an exposure is performed by second color signals, that is, electric signals corresponding to the image data of M and a magenta (M) toner image is form superimposed on the above-mentioned yellow (Y) toner image by the non-contact reversal development using the developing device for M.

In accordance with the same process, by employing the scorotron charging device 11 for cyan (C) positioned in the right side of the photoreceptor drum 10 and above the development casing 138 of the developing device 13 for cyan (C), the exposure optical system 12 for C and the developing device 13 for C, a cyan (C) toner image corresponding to the third color signals is further form superimposed and furthermore, by employing the scorotron charging device 11 for black (K) positioned in the right side of the photoreceptor drum 10 under the C and above the development casing 138 of the developing device 13 for black (K), the exposure optical system 12 and the developing device 13, a black toner Image corresponding to the forth color signals is form superimposed and during one rotation of the photoreceptor drum 10, a color toner image is formed on the surface.

Exposures onto the organic photosensitive layer of the photoreceptor drum using the exposure optical system 12 of these Y, M, C and K are performed through the above-mentioned substrate from the interior of the photoreceptor drum 10. Accordingly, any of image exposures corresponding to the second, third and forth color signals is performed while being subjected to no effect of the toner image formed in advance and thus, it is possible to form an electrostatic latent image equivalent to that corresponding to the first color signals.

With the use of the above-mentioned image forming process, on the photoreceptor drum 10 (image forming body), superimposed colored toner images are formed which become a reverse image, and the superimposed colored toner images as the reverse image are simultaneously transferred, in a transfer zone 14*b*, using a transfer device 14*c* (first transfer means) to which a direct current voltage having an opposite polarity to that of toner (in the present embodiment, positive polarity), to a toner image receiving member 14*a* (intermediate image receiving member) which is bridged between a drive roller 14*d* and a follower roller 14*e* so as to be adjacent to or in contact with the photoreceptor drum 10.

After transfer, the toner which remains on the surface of the photoreceptor drum 10 is cleaned at a cleaning device 19 by a cleaning blade made from rubber material which comes into contact with the photoreceptor drum 10 and the cleaned surface is successively employed to form a color image.

As mentioned above, after the superimposed colored toner images as a reverse image are formed on the toner image receiving member 14*a*, superimposed colored toner images to be an obverse image are successively formed on the photoreceptor drum 10 in the same manner as in the processes mentioned. At the time, the reverse image formed on the toner image receiving member 14*a* and the obverse image formed on the photoreceptor drum 10 are brought into synchronization in the transfer zone 14*b* and are set for forming both sided images. Further, it is necessary to change the image data so that a reverse image formed on the photoreceptor drum 10 is in a relation of a mirror image with an image formed at the time.

A copy sheet P as an image receiving material is sent out from a sheet supply cassette 15 as an image receiving material storing means; sent out by a sending out roller 15*a*; transported by a transport roller 15*b* and transported to a timing roller 15*c*.

The copy sheet P is transported to the transfer zone 14*b* upon the synchronization with both of colored toner image as an obverse image formed on the photoreceptor drum 10 and a colored toner image as a reverse image held on the toner image receiving member 14*a*. At the time, the copy sheet P is charged with a sheet charger 14*f* so as to have the same polarity as that of the toner; is adhered by the toner image receiving member 14*a* and transported to the transfer zone 14*b*. The charged copy sheet P having the same polarity as that of the toner does not attract a toner image on the toner image receiving member 14*a* and that on the photoreceptor drum 10 and prevents the distortion of the toner image in another area apart from the transfer zone. Furthermore, as a receiving material charging means, it is possible to employ an electrically conductive roller removably touchable, a brush charger or a corona charger.

The obverse images on the surface of the photoreceptor drum 10 are simultaneously transferred to an upper side (obverse side) of the copy sheet P by the transfer device 14*c* as the first transfer means to which a voltage having an opposite polarity (in the present embodiment, a positive polarity) of the toner is applied. At the time, the reverse images on the surface of the toner image receiving member 14*a* are not transferred to the copy sheet P and remain on the toner image receiving member 14*a*. Subsequently, the reverse images on the surface of the toner image receiving member 14*a* are simultaneously transferred to the lower side (reverse side) of the copy sheet P by a reverse surface transfer device 14*g* as the second transfer means to which a voltage having an opposite polarity of the toner is applied.

A toner image of each color is superimposed one by one. Therefore, in order to enable the simultaneous transfer, it is preferable that toners in the upper layer and the lower layer among the superimposed layers, have the same charge amount and the same polarity. On account of this, during the formation of images for both sides, the polarity of a colored toner image formed on the toner image receiving member 14*a* is reversed by corona discharging and the polarity of a colored toner image formed on the photoreceptor drum 10 is reversed by corona discharging. Thus, the toner in the lower layer is not fully charged to the same polarity and it is not preferred that transfer defects are caused.

It is preferable that the reversal development is repeated on the photoreceptor drum 10 and colored toner images having the same polarity formed by superimposition are simultaneously transferred to the toner image receiving member 14*a* without changing the polarity and transferred simultaneously to the copy sheet P without changing the polarity, because it contributes to the improvement in the transferability of the reverse surface image formation. For the obverse image formation, it is preferable that the reversal development is repeated on the photoreceptor drum 10 and colored toner images having the same polarity formed by superimposition are simultaneously transferred to the copy sheet P without changing the polarity, because it contributes to the improvement in the transfer performance of the obverse image formation.

As mentioned above, in the formation of a color image, with the use of the above-mentioned obverse or reverse image forming method, an image forming method on both surfaces is preferably employed in which a colored toner image is formed on the obverse surface of an image receiving material by driving the first transfer means and thereafter, a colored toner image is formed on a reverse surface of the image receiving material by driving the second transfer means.

The toner image receiving member 14*a* is an endless rubber belt having a thickness of 0.5 to 2.0 nm and is composed of two layers consisting of a semiconductive substrate of silicone rubber or urethane rubber having a resistance of $10^8$ to $10^{12}$ Ω·cm and a rubber substrate having a fluorine coating of a thickness of 5 to 50 μm on the external side as a toner filming preventing layer. It is preferable that this layer is similarly semiconductive. Instead of the rubber belt substrate, can be employed semiconductive polyester, polystylene, polyethylene, polyethylene terephathalate, polyimide, etc. having a thickness of 0.1 to 0.5 mm.

The copy sheet P having colored toner images on both the surfaces is subjected to charge elimination by a sheet separation AC electric eliminator 14*h* (hereinafter referred to as separation electrode), separated from the toner image receiving member 14*a* and advanced to a fixing device 17 as a fixing means which is composed of two rollers each of which has a heater in the inside. The copy sheet P is subjected to heat and pressure between a fixing roller 17*a* and a pressure roller 17*b* and thus toners adhered on both the surfaces are fixed. The resulting copy sheet P having copied images on both the surfaces is transported by a sheet exit roller 18 and ejected to a tray in the upper part of the apparatus while it is reversed so that the toner image as the reverse surface image becomes the upper surface.

The toner remaining on the surface of the toner image receiving member 14*a* after the transfer is cleaned by a blade which is removably brought into contacted with the toner image receiving member as a means to clean the toner image receiving member which is provided with a cleaning device 14*i* for a toner image receiving member. Furthermore, the toner remaining on the surface of the photoreceptor drum 10 after the transfer is advanced to the cleaning device 19 and removed by the cleaning blade 19*a* made from a rubber material which contacts with the photoreceptor drum 10 and fell down into a waste toner vessel not shown and recovered. The photoreceptor drum on which toner is removed is uniformly charged by the scorotron charging device 11 for Y and employed in the subsequent image forming cycle.

By employing the above-mentioned method, the superimposed colored toner images are simultaneously transferred. Accordingly, the color images on a toner image receiving member are hardly subjected to color registration error, toner scattering, abrasion, etc. and the excellent both sided color images having a little image degradation are formed.

As mentioned above, the photoreceptor drum 10 having a small-sized drum of an outer diameter ϕ of 50 to 100 mm can be employed as a result of the reduction in sizes of each exposure optical system 12 provided and each developing device 13. When the outer diameter ϕ is 50 mm or less, it becomes difficult to arrange each exposure optical system 12 in the photoreceptor drum 10. Furthermore, it becomes difficult to arrange four sets of the scorotron charging devices 11 and developing devices 13 around the outer circumference. When the outer diameter ϕ is 100 mm or more, the separating properties of the image receiving material from the photoreceptor drum 10 is degraded and a period of time necessary to form an image becomes longer than that required. Furthermore, a problem is caused in that the positioning accuracy is degraded due to the accuracy and deformation.

When the photoreceptor drum 10 has a small diameter, the length of outer circumference becomes short. As a result, it becomes difficult to form the transport system of the copy sheet P according to the result of a layout of the exposure optical system 12 and the developing device 13. However, as mentioned above, the exposure optical system 12 is reduced in size and arranged in the interior of the photoreceptor drum 10. Furthermore, each member of the developing device 13 is radiately arranged against the photoreceptor drum 10 which is positioned in the center. Thus, it becomes possible to arrange the development divice 13 of each color of Y, M, C and K above the horizontal line passing through the central axis of the photoreceptor drum 13 and pairing with the exposure optical system 12 corresponding to each color of Y, M, C and K. Furthermore, the apparatus to secure the ability of transfer and transportation of an image for the copy sheet P has been realized by arranging the transport system of the copy sheet P in the horizontal direction.

In the above mentioned color image forming apparatus, needless to say, one side surface copy is performed using the photoreceptor drum 10 as an image forming body or the toner image receiving member 14*a*.

According to FIG. 3, a holding member 20 to which the exposure optical system 12 is attached is inserted to a holding shaft 30 which is the central axis of the exposure optical system 12 and held. In the holding shaft 30, a pin 31 in the right side is put in the predetermined position. After the holding member 20 is inserted, the V-letter type groove on the right surface of the holding member 20 is brought into contact with the pin 31 in the right side, and thereafter, an E ring E1 is set to the predetermined groove in the left and the holding member 20 is fixed to the holding shaft 30.

In the state containing the exposure optical system 12, the photoreceptor drum 10 is inserted to the holding member 20 and right and left flange members 10A and 10B as a bearing member (the left side is the front side in FIG. 1 and the right side is the rear side in FIG. 1) in which bearing B1 and B2 as bearing member are forcibly put respectively are attached to the holding member 20 while the bearings B1 and B2 are respectively set to both of the right and left ends of the holding member 20. At the same time, the inner circumference surfaces of accepting portions 10*a* and 10*b* are covered and set respectively by both end portions of the outer circumference surfaces of the photoreceptor drum 10 and each exposure optical system 12 is positioned so as to share the central axis of the photoreceptor drum 12. Thus, a drum unit integrates the photoreceptor drum 10 and each exposure optical system 12 is assembled and constructed. In the outside of the above-mentioned flange member 10B, a image forming body driving gear 10G is provided.

The resin substrate of the photoreceptor drum 10 prepared by the centrifugal polymerization is excellent in the accuracy of the outer diameter and is readily set with the flange members 10A and 10B as covered from the outside.

The above-mentioned flange members 10A and 10B include, for example, an electrically conductive member such as aluminum and the electrically conductive layer of the photoreceptor drum 10 is grounded through the bearings B1 and B2.

The photoreceptor drum 10 integrated as a unit is fixed to the right and left side plate 301 (not shown) and 302 of the process cartridge 300 shown in FIG. 4 while each of the exposure optical system 12 is positioned. It is noted that the side plate 302 is the side plate in the rear side in FIG. 1.

According to FIG. 4 or FIG. 5, a belt-like side belt 303 is provided at the side wall of each of the right and left side plate 301 (not shown) and 302 of the process cartridge 300 and guide grooves 311 and 312 are made as guide means for setting the developing device 13 for each color and a plate spring 312*a* is provided at the end portion of the guide groove 312. The side plate 301 of the front side of the process cartridge 300 in FIG. 1 and guide grooves 311 and 312 set at the side plate 301 are provided symmetrically for the side plate 302 in the rear side.

Two guide pins 138*a* provided on the outer wall of the development casing of the developing device 13 are inserted to the guide grooves 311 and 312 and the developing device 13 is installed. A space roller 137 as a gap holding means provided at both the ends of a developing sleeve 131 of the developing device 13 comes into contact with accepting portions 10*a* (not shown), and 10*b* of the flange members 10A (not shown) and 10B which hold the photoreceptor drum 10 and in the state wherein the predetermined gap between the photoreceptor drum 10 and the developing sleeve 131 of the developing device 13 is held, a guide pin 138*a* is engaged with a plate spring 312*a* and the developing device 13 is positioned and fixed.

By letting the gap holding member be brought into contact with the flange member, the image forming body composed of the resin substrate is neither deformed nor damaged by the gap holding member and the accurate gap between the image forming body and the development means is held. Furthermore, no influence is subjected due to the deformation of the image forming body caused by the forcible insertion of the flange member, especially the deformation of the image forming body when a resin is employed and the predetermined gap between the image forming body and the development means is accurately set. In addition, by arranging the guide means, the exchange of each development means is readily performed.

In the same manner, the process cartridge 300 is constructed in such a way that two pins, not shown, provided in the cleaning device 19 are inserted into the holder composed of a plate spring 313 provided in two positions on each side wall of the left and right side plate 301 (not shown) and 302 of the process cartridge 300 and the cleaning device 19 is engaged and attached to the side plates 301 (not shown) and 302.

The process cartridge 300 being attached to the main body of the color image forming apparatus, the gear G3 provided on the side plate 302 in the rear side of the process cartridge 300 in FIG. 1 is engaged with a gear, not shown, connecting a drive motor for the main body of the apparatus and an image forming body driving gear 10G is rotated via gears G3, G2 and G1 and the photoreceptor drum 10 is rotated and driven.

The image forming body driving gear 10G provided in the photoreceptor drum 10 and at least the final gear G1 of the driving system connecting the image forming body driving gear 10G are constructed with a helical gear and during rotation, the photoreceptor drum 10 is pushed in the arrow direction and play in the thrust direction of the bearings B1 and B2 as the bearing member which are set in the flange member 10B and 10A (not shown) and both ends of the holding member is adjusted and rotated in a pushed state in one direction. According to this, the position deviation of an exposure light of each exposure optical system on the image forming body, which is caused by the play is prevented and excellent superimposed colored toner images are formed in which registration is performed with high precision.

Further, in this embodiment, being different from the second and third embodiments mentioned hereinafter, it is possible to arrange, against the central axis direction (width direction) of the photoreceptor drum 10, a contact portion with the outer circumference surface of the flange member 10B of the space roller 137 as the gap holding member and the bearing B2 as the bearing member which is forcibly inserted to the inner circumference surface of the flange member 10 while matching the phase. Thus, it is possible to shorten the length of the width direction of the photoreceptor drum 10 and the size reduction of the process cartridge 300 is accomplished.

Figure 6:
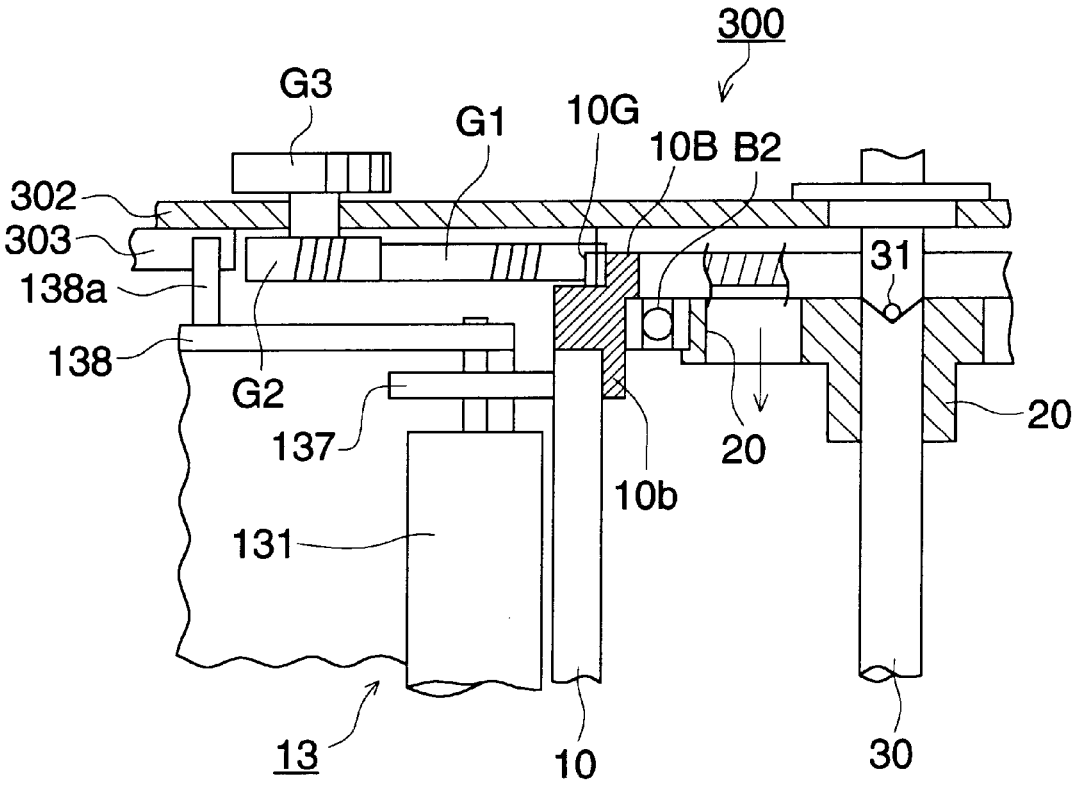
FIG. 6 is a diagram showing the second example of the contact method of a gap-holding means.

Other embodiments of the contact method of the gap holding means are explained with reference to FIGS. 6 and 7. FIG. 6 is a diagram showing the second embodiment of the contact method of the gap holding member and FIG. 7 is a diagram showing the third embodiment of the contact method of the gap holding means.

As shown in FIG. 6, in the same way as the above-mentioned embodiment, the space roller 137 as the gap holding member arranged at both ends of the developing sleeve 131 of the developing device 13 is brought into contact with both ends of the photoreceptor drum 10 and the contact portion of the above-mentioned space roller 137 with the photoreceptor drum 10, more preferably the bearing B2 as the bearing member is arranged in the outer side of the accepting portion 10*b* for the photoreceptor drum 10 of the flange member 10B and furthermore, in the outside, the image forming body driving gear 10G is arranged. By arranging the image forming body driving gear and the bearing member in the outside of the contact portion with the image forming body composed of the resin substrate of the gap holding means, vibration is absorbed by the resin substrate and no direct vibration caused by the image forming body driving gear and bearing member is transferred. Thus, the gap between the image forming body and the developing means is held with high precision due to no appreciable effect of vibration, especially vibration of the image forming body driving gear.

Figure 7:
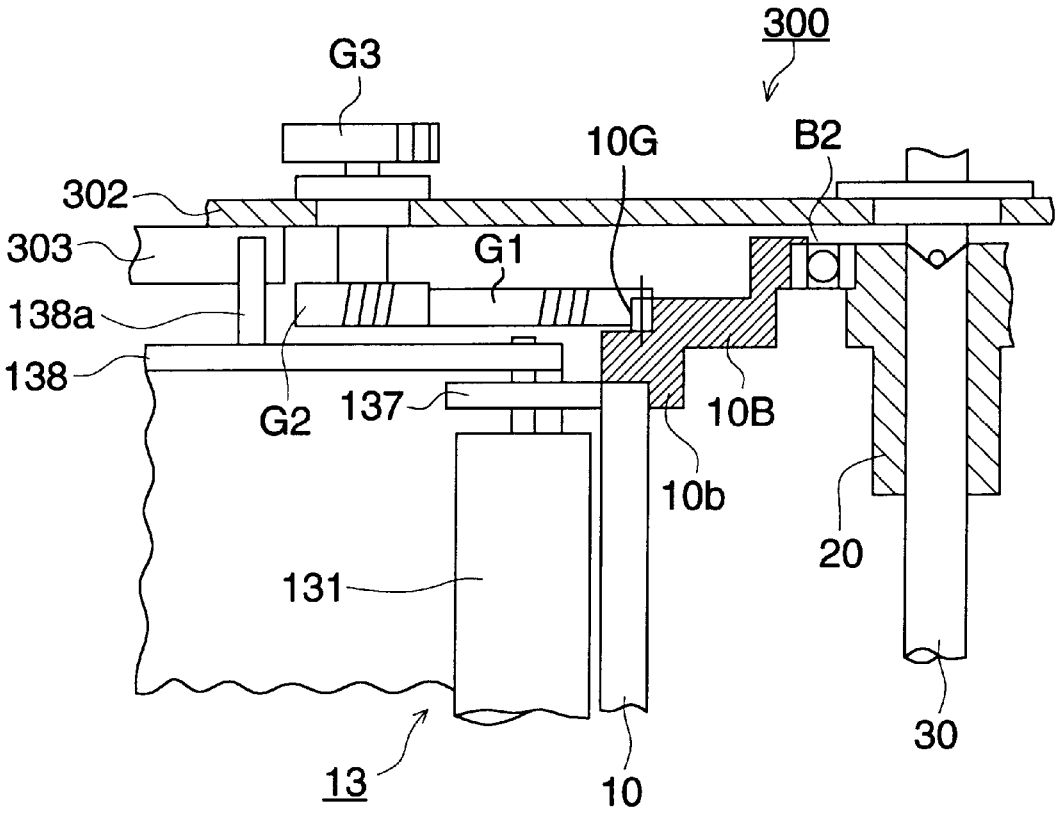
FIG. 7 is a diagram showing the third example of an contact method of a gap-holding means.

In addition, as shown in FIG. 7, in the same manner as in the above-mentioned first and second embodiments, the space roller 137 as the gap holding means arranged at both ends of the developing sleeve 131 of the developing device 13 is brought into contact with both ends of the photoreceptor drum 10 and the contact portion of the above-mentioned space roller 137 with the photoreceptor drum 10, more preferably the image forming body driving gear 10G is arranged in the outside of the accepting portion 10*b* of the photoreceptor drum 10 of the flange member 10B and furthermore, in the outside, the bearing B2 as the bearing member is arranged. By arranging the image forming body driving gear and the bearing member in the outside of the contact portion with the image forming body composed of the resin substrate of the gap holding means, vibration is absorbed by the resin substrate and no direct vibration caused by the image forming body driving gear and bearing member is transferred. Thus, the gap between the image forming body and the developing means is held with high precision due to small effect of vibration, especially vibration of the image forming body driving gear.

According to the present invention, by allowing the gap holding member to come into contact with the flange member, the image forming body composed of the resin substrate is neither deformed nor damaged by the gap holding member and the accurate development gap is held between the image forming body and the developing means. Furthermore, the predetermined gap distance with high precision is set without receiving an adverse effect due to the deformation of the image forming body caused by the forcible insertion of the flange member, especially the deformation of the image forming body composed of a resin.

Furthermore, the exchange of each developing means is readily performed.

Furthermore, by arranging the image forming body driving gear and the bearing member in the outside of the contact portion of the gap holding member with the image forming body composed of the resin substrate, the vibration is absorbed by the resin substrate and the vibration effect due to the image forming body driving gear and the bearing member is decreased and the vibration effect due to the image forming body driving gear is minimized.

Figure 8:
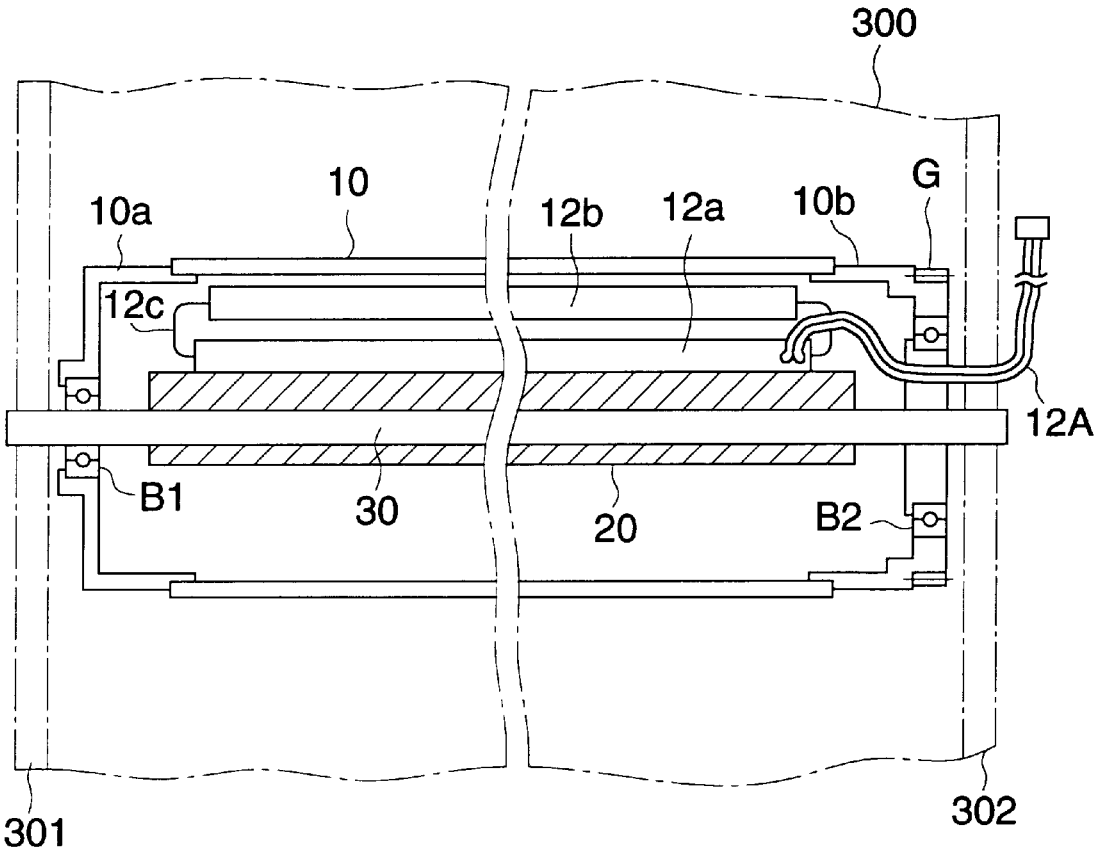
FIG. 8 is a side sectional view showing another example of the image forming body in FIG. 1.
Figure 9:
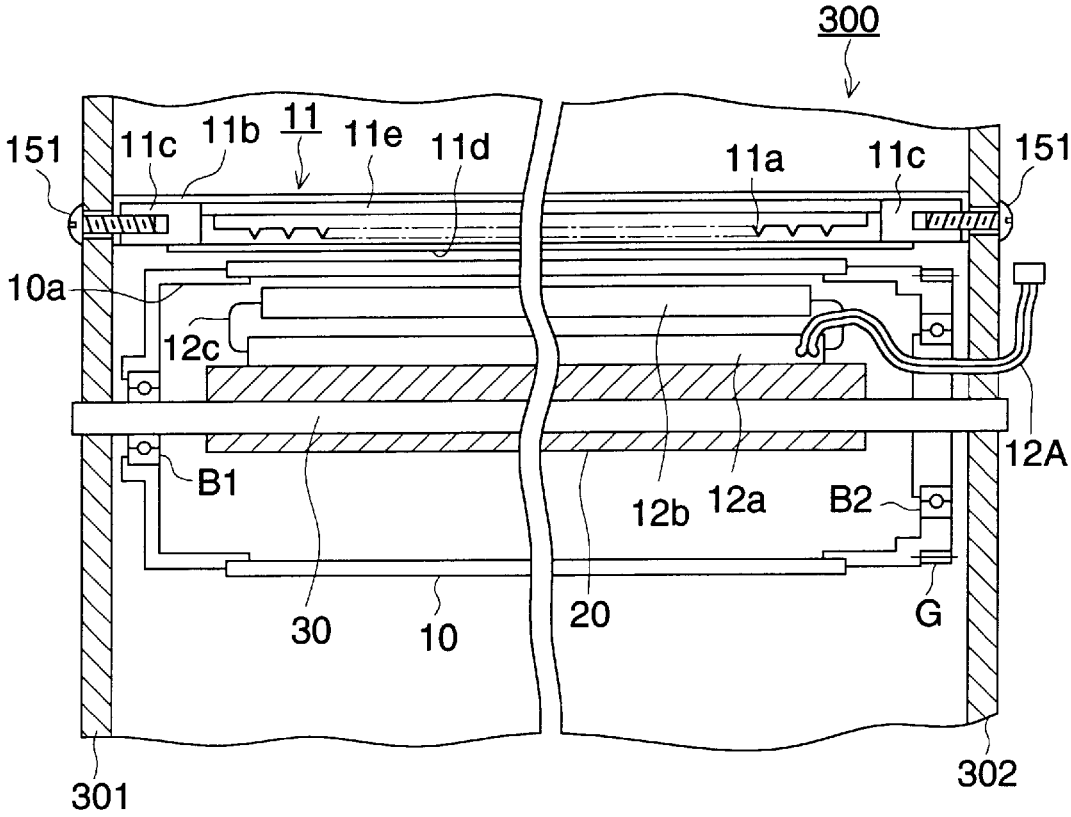
FIG. 9 is a diagram showing one example of a contact method of a charging means to a process cartridge.
Figure 10:
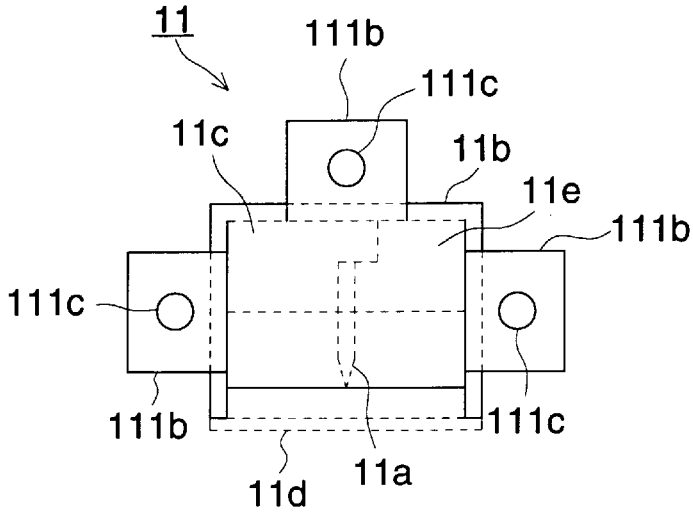
FIG. 10 is a diagram showing another example of a contact method of charging means to a process cartridge.

Next, in one embodiment of the color image forming apparatus for accomplishing the second object of the present invention, the image forming process and each mechanism are explained with reference to FIG. 1 and FIGS. 8 to 11. FIG. 8 is a sectional view of another embodiment of the image forming body of FIG. 1; FIG. 9 is a diagram showing one embodiment of an contact method of a process cartridge with a charging means; FIG. 10 is a diagram showing another embodiment of the contact method of a process cartridge with a charging means and FIG. 11 a diagram showing one embodiment of the contact method of a process cartridge with a developing means.

As shown in FIG. 8, the photoreceptor drum 10 whose flange members 10*a* and 10*b*, engaging and fixing it, are subjected to bearing by the bearing B1 and B2 engaged to both the ends of the flange members 10*a* and 10*b* is rotatably held against the holding axis 30 bridged and fixed between both the side plates 301 and 302 of the process cartridge 300, and is driven while a gear G integrally connected with the flange member 10 is engaged with the driving gear of the apparatus body side.

The photoreceptor drum 10 and the exposure optical system 12 are integrally arranged and while the exposure optical system is definitely positioned, the holding shaft 30 holding the photoreceptor drum 10 and the exposure optical system 12 is fixed to both the side plates 301 and 302 constructing the enclosure of the process cartridge 300. Furthermore, after the scorotron charging device 11 and the cleaning device 19 for each color are fixed to the predetermined position of each of both the side plates 301 and 302, each developing device 13 is attached and the process cartridge is constructed.

Accordingly, each of the above-mentioned developing device shown in the embodiment of FIG. 1 is removably placed as mentioned hereinafter in the process cartridge 300 upon fixing the scorotron charging device 11 and the cleaning device 19 to both side plates 310 and 302 of each process cartridge 300 and through the operation in that, for example, the process cartridge 300 is detached horizontally from the front side in FIG. 1, each developing device 13 is detached integrally from the apparatus body together with each scorotron charging device 11 and cleaning device 19.

As shown in FIGS. 9 and 10, the saw-toothed electrode 11*a* is attached while being held between a stationary block 11*c* and an electrode holding member 11*e* and furthermore, the stationary block 11*c* to which the saw-toothed electrode 11*a* is attached is attached to the side plate 11*b* as a shielding member. Furthermore, the control grid 11*d* is attached to the surface of the stationary block 11*c* at the top side of the saw-toothed electrode 11*a* and the scorotron charging device 11 is thus constructed.

As shown on FIG. 9, the scorotron charging device 11 for each color is positioned so as to provide a predetermined gap against the photoreceptor drum 10 and is fixed, at the predetermined position on the surface of the photoreceptor drum 10, to the side plate plates 301 and 302 constructing the enclosure of the process cartridge 300 upon fixing both ends of the stationary block 11*c* with screws 151.

Furthermore, as shown in FIG. 10, at both ends of the side plate 11*b* of the scorotron charging device 11, a fixing portion 111*b* folded to three ways is provided and can be fixed to the side plates 301 and 302 of both the sides by screws 151 through screw holes of the fixing portion 151.

A plurality of the scorotron charging devices 11 for each color is fixed to the side plates 301 and 302 of both the sides constructing the enclosure of the process cartridge 300 and is provided as a reinforcement member of the enclosure of the process cartridge 300.

In the same way, the cleaning device 19 is fixed to the side plates 310 and 302 of both the sides of process cartridge 300 upon fixing the casing of the cleaning device 19 with screws.

As mentioned above, by fixing the charging means, especially a plurality of the charging means to between the plates of both sides of the process cartridge, the charging means work as the replacement of the conventional enforcing members such as a stay, etc. which have been employed. As a result, a large room is taken by a plurality of removably attached developing means and the enclosure of the process cartridge for which it is difficult to provide an enforcing member is enforced. Particularly, the enforcement is suitably performed because the charging means are arranged near the surroundings of an image holding member and four of them are arranged.

Figure 11:
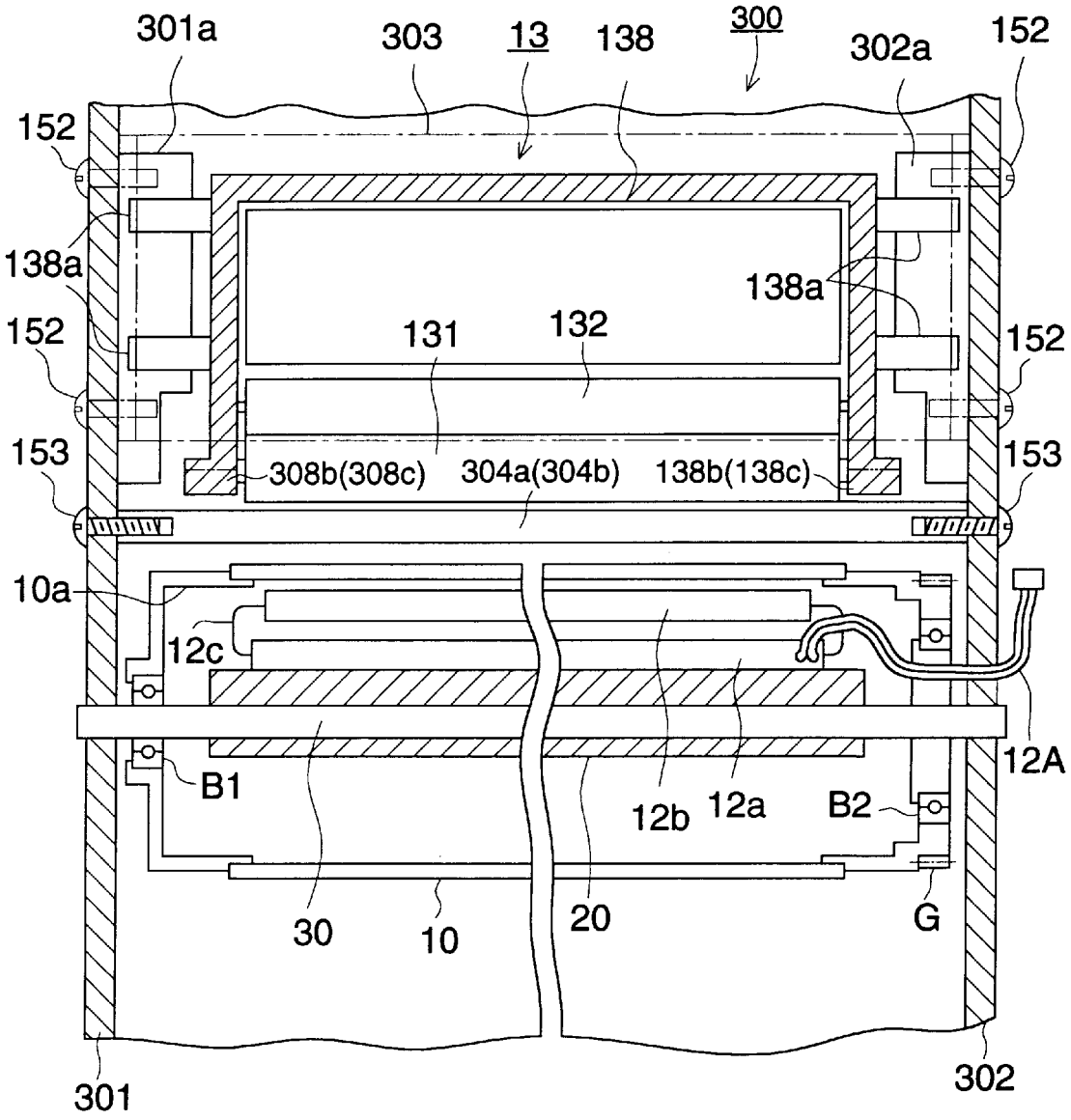
FIG. 11 is a diagram showing one example of a contact method of a developing means to a process cartridge.

Furthermore, as shown in FIG. 11 or FIG. 1, in the process cartridge 300, guide rails 301*a* and 302*a* for attaching removably the developing device for each color are provided to each of both the side plates 301 and 302 and a guide plate 303 which is fixed by screws 152 so that it is trained between both the side plates 310 and 302. The guide rails 301*a* and 302*a* corresponding to the developing device for each color are placed in parallel to the guide plate 303 as a plate member and arrange fixed using both the side plates 301 and 302.

Employing the guide plate 303, and the guide rails 301*a* and 302*a* as a guide, the developing device is inserted between the guide plate 303, and the guide rails 301*a* and 302*a*. Guide pins 138*a*, two of each, provided at both the sides of the development casing 138 of the developing device 13 are engaged to the inside of the facing guide rails 301*a* and 302*a* and furthermore, the side portion of the development casing 138 is brought into a contact with the inside of the guide plate 303. As employing the guide plate 303, and the guide rails 301*a* and 302*a* as a guide, the developing device 13 is inserted in parallel to the guide plate 303, and the guide rails 301*a* and 302*a* as shown by arrow in FIG. 1.

In accordance with the insertion of the developing device 13, contact portions 13*b* and 13*c* having a sectional shape of a circular arc provided of each of both the sides of the development casing 138 are engaged, at the top of the inserting direction of the developing device 13, to rod-like positioning rods as positioning members for the developing means of which both ends are fixed to both the side plates 301 and 302 by screws 153, and the developing sleeve 131 of the developing device 13 and the photoreceptor drum 13 are attached to the developing device 13 while making the predetermined gap, and the rear side of the developing device 13 is fixed by a fixing member, not shown, upon being elastically pushed and fixed to the process cartridge 300.

The guide plate 303 or positioning rods 304*a* and 304*b* provided for a plurality of developing devices for each color are fixed to the side plates 301 and 302 of both the sides fabricating the enclosure of the process cartridge 300 and are provided as an enforcing member for the process cartridge 300.

In the case of the maintenance and exchange of the developing device 13, the process cartridge 300 is pulled out from the color image forming apparatus body and the above mentioned engaging member (not shown) is disengaged and the developing device 13 is detached from the process cartridge 300. At the time, the developing device 13 and the scorotron charging device are integrally united and may make it possible to exchanged together with it.

As mentioned above, by fixing the guide plate for detaching the developing device and positioning member for the developing means, especially a plurality of guide plates or a plurality of positioning members between the plates of both the side of the process cartridge, the guide plates and positioning members replace enforcing members in which a stay, etc. have been conventionally employed and a large room is taken by a plurality of removably attached development means and the enclosure of the process cartridge for which it has been difficult to provide the enforcing member is enforced.

According to the present invention, by fixing the charging means to between both side plates of the process cartridge, the enclosure of the process cartridge which makes it possible to render a plurality of development means removably attachable is enforced.

Furthermore, by fixing the plate member such as the guide plate for detaching the development means which is removably attached to the above-mentioned process cartridge, the enclosure of the process cartridge which makes it possible to render a plurality of development means removably attachable is enforced without providing specially the enforcing member.

Furthermore, by fixing the positioning member for the development means which is removably attached to the above-mentioned process cartridge to between plates of both the side of the above-mentioned process cartridge, the enclosure of the process cartridge which makes it possible to render a plurality of development means removably attachable is enforced without providing specially the enforcing member.

What is claimed is:

1. A color image forming apparatus comprising:

(a) a rotary image forming body;

(b) a plurality of charging devices provided along the image forming body for charging the image forming body;

(c) a plurality of exposure devices each provided inside the image forming body for imagewise exposing the image forming body to form a latent image;

(d) a plurality of developing devices each storing therein a different colored developer, said plurality of developing devices being provided along the image forming body for developing the latent image formed on the image forming body to form a Plurality of different colored toner images, wherein the plurality of different colored toner images are superimposed on the image forming body through successive repeating of charging by the charging devices, imagewise exposing by the exposure devices and developing by the developing devices to form a superimposed colored toner image during one rotation of the image forming body, and wherein the superimposed colored toner image is then collectively transferred onto a transfer member; and (e) a process cartridge integrally including the plurality of charging devices, wherein the image forming body includes therein the plurality of exposure devices and the plurality of developing devices, wherein the plurality of developing devices are detachably attachable to the process cartridge, wherein the image forming body includes a flange member, and each of the plurality of developing devices comprises a gap keeping member for keeping a gap between the image forming body and each of the plurality of developing devices, wherein the gap keeping member is brought into pressure contact with the image forming body while facing the flange member, wherein the apparatus further comprises a bearing member for supporting the image forming body, a driving gear for driving the image forming body, and a holding member for holding the plurality of exposure means, and wherein the bearing member is arranged inside the flange member, the driving gear and the gap keeping member are arranged outside the flange member, and the holding member is arranged inside the bearing member.

2. The color image forming apparatus of claim 1, wherein a substrate of the image forming body is made of resin or glass.

3. The color image forming apparatus of claim 1, wherein the gap keeping member is directly brought into pressure contact with the flange member.

4. The color image forming apparatus of claim 1, wherein the gap keeping member is brought into pressure contact with the flange member through a substrate of the image forming body.

5. The color image forming apparatus of claim 1, wherein the flange member is provided on the image forming body such that an outer circumferential surface of the image forming body is covered by the flange member.

6. The color image forming apparatus of claim 1, wherein the process cartridge includes a guiding member for guiding the respective developing devices to be inserted into the process cartridge so that the plurality of the developing devices may be respectively attached to the process cartridge.

7. The color image forming apparatus of claim 1, wherein the bearing member and the driving gear are provided outside a contact portion where the gap keeping member is brought into pressure contact with the image forming body, with the driving gear being provided further outside the contact portion.

8. The color image forming apparatus of claim 7, wherein the process cartridge includes a guiding member for guiding the respective developing devices to be inserted into the process cartridge so that the plurality of the developing devices may be respectively attached to the process cartridge.

9. The color image forming apparatus of claim 1, wherein the driving gear and the bearing member are provided outside a contact portion where the gap keeping member is brought into pressure contact with the image forming body, with the bearing member being provided further outside the contact portion.

10. The color image forming apparatus of claim 9, wherein the process cartridge includes a guiding member for guiding the respective developing devices to be inserted into the process cartridge so that the plurality of the developing devices may be respectively attached to the process cartridge.

11. A color image forming apparatus comprising:

(a) a rotary image forming body;

(b) a plurality of charging devices provided along the image forming body for charging the image forming body;

(c) a plurality of exposure devices each provided inside the image forming body for imagewise exposing the image forming body to form a latent image;

(d) a plurality of developing devices each storing therein a different colored developer, said plurality of developing devices being provided along the image forming body for developing the latent image formed on the image forming body to form a plurality of different colored toner images, wherein the plurality of different colored toner images are superimposed on the image forming body through successive repeating of charging by the charging devices, imagewise exposing by the exposure devices and developing by the developing devices to form a superimposed colored toner image during one rotation of the image forming body, and wherein the superimposed colored toner image is then collectively transferred onto a transfer member; and (e) a process cartridge integrally including the plurality of charging devices, wherein the image forming body includes therein the plurality of exposure devices and the plurality of developing devices, wherein the plurality of developing devices are detachably attachable to the process cartridge, and wherein the process cartridge further includes side plates at both sides thereof, and wherein the plurality of charging devices are fixed between the side plates.

12. A color image forming apparatus comprising:

(a) a rotary image forming body;

(b) a plurality of charging devices Provided along the image forming body for charging the image forming body;

(c) a plurality of exposure devices each provided inside the image forming body for imagewise exposing the image forming body to form a latent image;

(d) a plurality of developing devices each storing therein a different colored developer, said plurality of developing devices being provided along the image forming body for developing the latent image formed on the image forming body to form a plurality of different colored toner images, wherein the plurality of different colored toner images are superimposed on the image forming body through successive repeating of charging by the charging devices, imagewise exposing by the exposure devices and developing by the developing devices to form a superimposed colored toner image during one rotation of the image forming body, and wherein the superimposed colored toner image is then collectively transferred onto a transfer member; and (e) a process cartridge integrally including the plurality of charring devices, wherein the image forming body includes therein the plurality of exposure devices and the plurality of developing devices, wherein the plurality of developing devices are detachably attachable to the process cartridge, and wherein the process cartridge further includes side plates at both sides thereof, and a plate member in parallel to each of the developing devices which is fixed on the side plates.

13. The color image forming apparatus of claim 12, wherein the plate member comprises a guide plate for guiding each of the plurality of developing devices so as to be detachably attached to the process cartridge.

14. A color image forming apparatus comprising:

(a) a rotary image forming body;

(b) a plurality of charging devices provided along the image forming body for charging the image forming body;

(c) a plurality of exposure devices each provided inside the image forming body for imagewise exposing the image forming body to form a latent image;

(d) a plurality of developing devices each storing therein a different colored developer, said plurality of developing devices being provided along the image forming body for developing the latent image formed on the image forming body to form a plurality of different colored toner images, wherein the plurality of different colored toner images are superimposed on the image forming body through successive repeating of charging by the charging devices, imagewise exposing by the exposure devices and developing by the developing devices to form a superimposed colored toner image during one rotation of the image forming body, and wherein the superimposed colored toner image is then collectively transferred onto a transfer member; and (e) a process cartridge integrally including the plurality of charging devices, wherein the image forming body includes therein the plurality of exposure devices and the plurality of developing devices, wherein the plurality of developing devices are detachably attachable to the process cartridge, wherein the process cartridge further includes side plates at both sides thereof, and a positioning member for each of the plurality of developing devices which is fixed between the side plates.

15. The color image forming apparatus of claim 14, wherein the positioning member is bar-shaped.

* * * * *